US006193224B1

(12) United States Patent
Dillner et al.

(10) Patent No.: US 6,193,224 B1
(45) Date of Patent: Feb. 27, 2001

(54) SWING DRIVE MECHANISM FOR CHILD'S SWING

(75) Inventors: James Dillner, Leola; Daniel R. Mitchell, Morgantown, both of PA (US)

(73) Assignee: Graco Children's Products Inc., Elverson, PA (US)

( * ) Notice: Subject to any disclaimer, the term of this patent is extended or adjusted under 35 U.S.C. 154(b) by 0 days.

(21) Appl. No.: 09/104,286

(22) Filed: Jun. 24, 1998

(51) Int. Cl.[7] ..... F16F 1/14
(52) U.S. Cl. ..... 267/154; 422/114
(58) Field of Search ..... 267/154; 472/118, 472/119, 120, 121, 122, 123, 124, 125; 74/48

(56) References Cited

U.S. PATENT DOCUMENTS

| | | | | |
|---|---|---|---|---|
| 2,810,153 | * | 10/1957 | Semar | 267/154 |
| 3,358,659 | * | 12/1967 | Renger | 267/154 |
| 4,150,829 | | 4/1979 | Bochmann . | |
| 4,911,429 | | 3/1990 | Ogbu | 272/86 |
| 5,083,773 | | 1/1992 | Saint | 272/86 |
| 5,172,955 | | 12/1992 | Freese et al. . | |
| 5,348,378 | * | 9/1994 | Zhang | 267/154 |
| 5,376,053 | | 12/1994 | Ponder et al. | 472/119 |
| 5,378,196 | | 1/1995 | Pinch et al. | 472/119 |
| 5,525,113 | | 6/1996 | Mitchell et al. | 472/119 |
| 5,664,289 | * | 9/1997 | Wolda et al. | 267/154 |
| 5,833,545 | * | 11/1998 | Pinch et al. | 472/119 |
| 5,846,136 | * | 12/1998 | Wu | 74/48 |

FOREIGN PATENT DOCUMENTS

| | | |
|---|---|---|
| 877668 | 4/1960 | (GB) . |
| 1070921 | 12/1963 | (GB) . |
| 1371481 | 4/1973 | (GB) . |
| 2015887 | 3/1979 | (GB) . |

* cited by examiner

*Primary Examiner*—Robert J. Oberleitner
*Assistant Examiner*—Robert A. Siconolfi
(74) *Attorney, Agent, or Firm*—Foley & Lardner

(57) ABSTRACT

A swing drive mechanism is provided for use with infant's and child's swings. The swing drive mechanism provides an input mechanism, an output mechanism, and a torsion spring member disposed between the input mechanism and the output mechanism. The torsion spring member includes a first portion and a second portion that interact together to produce a desirable spring gradient while also reducing the overall length of the torsion spring member. The torsion spring member is secured into attachment with the input mechanism by a novel securement mechanism. The output mechanism includes an axle and a drive flange. Preferably, the features of the input mechanism, the output mechanism, and each portion of the torsion spring member are integrally formed.

27 Claims, 9 Drawing Sheets

SWING DRIVE MECHANISM FOR CHILD'S SWING

Generally, this invention relates to swings. More particularly, this invention relates to a drive mechanism for use in an infant's or child's swing.

BACKGROUND OF THE INVENTION

Various types of swings are well known in the art. Generally, swings include a support frame, a hanger pivotally attached to the support frame, and a seat attached to the hanger. Such devices are designed to swing the seat in a pendulum motion. However, due to frictional loses and wind resistance, additional energy must be supplied to this system in order to maintain an approximately constant amplitude over time. Often manually powered or electrically powered drive mechanisms are utilized to supply the lost energy.

As shown in FIG. 1, one prior art swing, which is commonly assigned to the assignee of the present invention and hereby incorporated by reference, is U.S. Pat. No. 5,525,113 to Mitchell et al. The device to Mitchell et al. is a swing assembly that includes a swing drive mechanism (10). The swing drive mechanism (10) has a drive sleeve (12) rotatably mounted to an axle (14) that operatively supports the hanger, not shown. A drive flange (16) is mounted on the axle (14) with a drive flange coupling device (18) positioned between the drive sleeve (12) and the drive flange (16) to provide a limited lost motion connection. The drive flange coupling device (18) includes a hub member (20) coaxially and rotatably mounted on the axle (14) and at least one torsion spring, shown as a pair of torsion springs **(24*a*, 24*b*), mounted coaxially on the hub member (20). A crank, not shown, driven by a motor, not shown, is commonly linked to the drive sleeve (12) through a channel (26) to oscillate the drive sleeve (12)** .

Although the above disclosed device has substantially advanced the art, it has been found that further advancements could still be made. For instance, the swing drive mechanism to Mitchell et al. has at a minimum a total of six parts: the drive sleeve (12), the pair of torsion springs **24(*a*) and 24(*b*), the hub member (20), the drive flange (16), and the axle (14). Further, the swing drive mechanism (10) requires additional mechanisms to couple the swing drive mechanism (10) with the hub, not shown. In addition, other mechanisms are needed to secure the drive sleeve (12), the torsion springs (24*a*, 24*b*), the hub member (20), and the drive flange (16) on axle (14)**.

Secondly, although the device to Mitchell et al. provides superior performance over other swing drive mechanisms, it has been found that the assembly operation of such devices is somewhat complicated. Accordingly, the various elements are prone to being misassembled. As such, it would be desirable to provide a swing drive mechanism that maintains the superior performance as disclosed in Mitchell et al. while also being configured to simplify the assembly operation and minimize the opportunity for misassembly.

In light of the above, one skilled in the art can appreciate that it would be desirable to provide a swing drive mechanism that minimizes frictional loses and minimizes the overall size of swing drive mechanisms. However, in addition, it would also be desirable to have a swing drive mechanism that reduces the overall number of parts required as well as reduce the opportunity for misassembly.

SUMMARY OF THE INVENTION

It is an object of this invention to provide a swing drive mechanism that reduces the number of separate parts needed.

It is a further object of this invention to provide the swing drive mechanism with features that simplify the assembly process.

It is still a further object of this invention is to provide the swing drive mechanism with features that reduce undesirable wear and friction.

It is an additional object of this invention to achieve the above advantages without increasing the amount of space occupied by the swing drive mechanism.

In accordance with a preferred embodiment of this invention, these and other objects and advantages are accomplished as follows.

The present invention provides a swing drive mechanism for use in an infant's or child's swing. Swings commonly include a support frame having at least one hanger pivotally connected to the support frame. Often the hanger is in turn attached to a seat. The seat is thus permitted to oscillate along an arcute path approximating pendulum motion. The energy required to start and maintain the pendulum motion of the swing is commonly supplied by manual energy, such as a wound coil spring which is wound by the user, or by electrical energy, which operates an electrical motor. However, one skilled in the art can appreciate that the novel aspects of the present invention are equally applicable to swings regardless of the energy source utilized.

The swing drive mechanism of the present invention generally includes an input mechanism, a torsion spring member connected to the input mechanism, and an output mechanism associated with the input mechanism and interacting with the torsion spring member. The torsion spring member of this invention includes a first portion having a length. In addition, the torsion member has a second portion parallelly disposed and distanced apart relative to the first portion. The second portion also has a length. Preferably, the first portion and the second portion are approximately equal in length.

The output mechanism of this invention includes an axle and a drive flange attached to the axle. The axle also includes a mechanism for reducing friction between the output mechanism and the torsion spring member disposed on the drive flange. The swing drive mechanism of this invention includes an input mechanism. The input mechanism includes a spring securement mechanism. In addition, the input mechanism includes an axle engagement member disposed proximate to the spring securement mechanism. Further, the input mechanism includes a crank engagement mechanism proximate the axle engagement mechanism. Preferably, the spring securement mechanism, the axle engagement mechanism, and the crank engagement mechanism are integrally formed together. However, one skilled in the art can appreciate that the various novel aspects of this invention may be achieved without integrally forming these members together.

The worker assembling the above disclosed invention is provided with an uncomplicated assembly process. First, the user may secure the torsion spring member with the spring securement mechanism on the input mechanism. Next, the worker will associate the input mechanism with the output mechanism. The input mechanism is retained with the output mechanism by the axle engagement mechanism. Then, the input mechanism is operatively connected with the crank by the crank engagement mechanism. One skilled in the art can appreciate the above disclosed invention provides a multitude of advantages. First, the swing drive mechanism of the present invention substantially reduces the number of separate parts necessary for assembly. In a preferred embodiment, the swing drive mechanism includes an input mechanism, and output mechanism and a torsion spring member. Accordingly, the present invention has substantially reduced the number of separate parts utilized in manufacturing the swing drive mechanism.

Another advantage of the present invention is that the swing drive mechanism includes a mechanism to reduce friction that occurs between the torsion spring member and the output member within the swing drive mechanism. Accordingly, the amount of energy supplied to the swing drive mechanism is reduced. Also, the opportunity for failure due to wear is similarly reduced.

Another advantage found in the swing drive mechanism of this invention is that the swing drive mechanism minimizes the amount of space occupied by the swing drive mechanism. Preferably , the torsion spring member has a first portion and an second portion approximately equal in length. Since, the spring gradient achievable for a torsion spring member is dependent upon the length of the torsion spring member, having a spring with a first member and a second member, which both operate as a spring approximately reduces the necessary length of the torsion spring member in half while maintaining an approximately similar spring gradient as a single linear torsion spring having a length twice as long.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
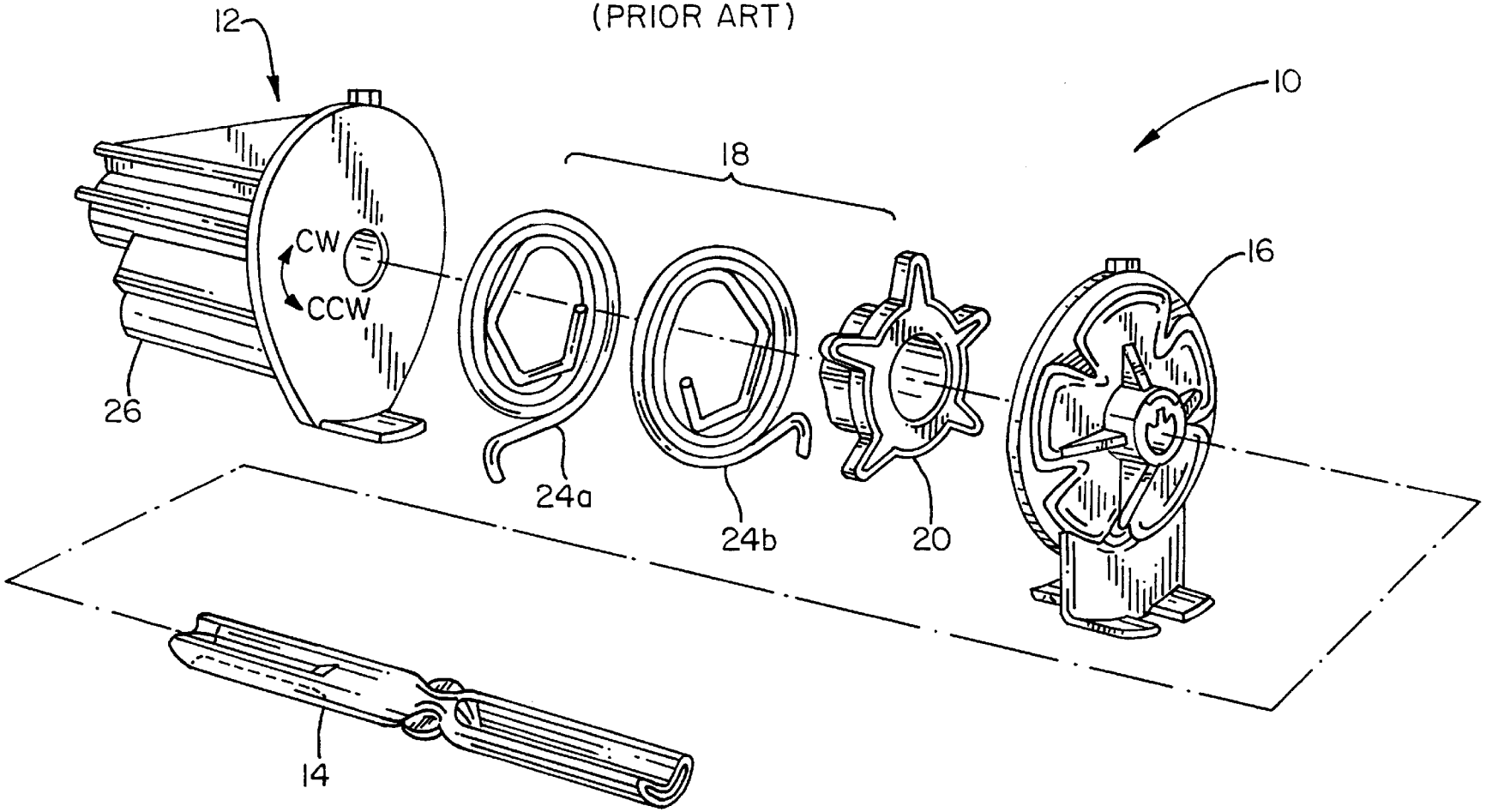
FIG. 1 (PRIOR ART)
FIG. 1 shows an exploded perspective view of a prior art swing drive mechanism.
Figure 2:
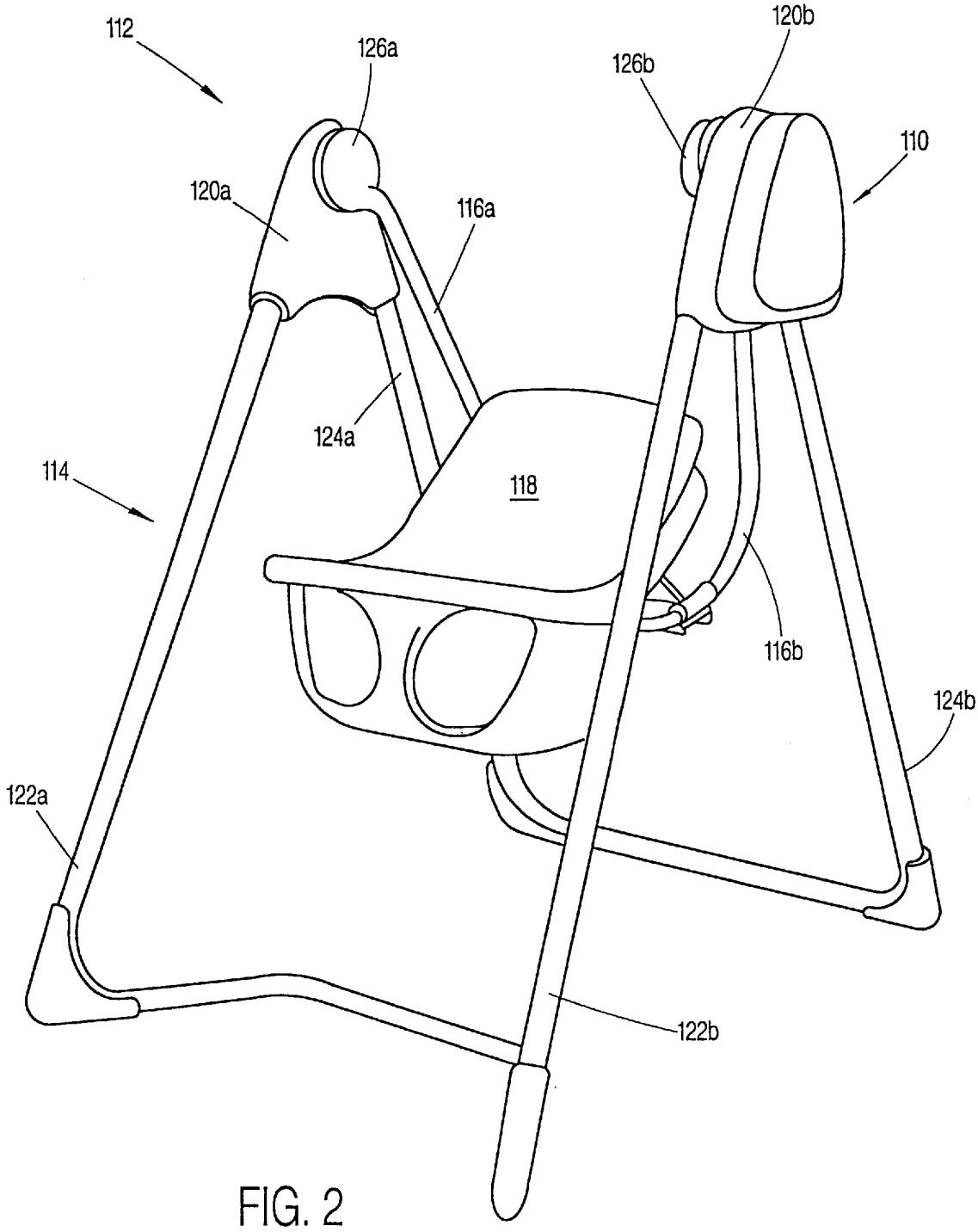
FIG. 2 shows a perspective view of a child's swing.

The spring drive mechanism (110) of this invention is uniquely configured for use in an infant's or child's swing. As shown in FIG. 2, a swing (112) commonly includes a support frame (114) having at least one hanger (116*a*, 116*b*) pivotally connected to the support frame (114). The hanger (116*a*, 116*b*) is in turn attached to a seat (118). The support frame (114) includes a pair of leg connectors (120*a*, 120*b*). In addition, the support frame includes a pair of front legs (122*a*, 122*b*) and a pair of rear legs (124*a*, 124*b*) attached to the leg connectors (120*a*, 120*b*). The leg connectors (120*a*, 120*b*) provide support for the corresponding hubs (126*a*, 126*b*), which provide a pivot point around which the pendulum motion of the seat (118) occurs. The swing drive mechanism (110) is shown in FIG. 2 as being associated with leg connector (120*b*). However, one skilled in the art can appreciate that the unique aspects of this invention could instead be associated with the leg connector (120*a*) without departing from the novel aspects of this invention. Secondly, FIG. 2 shows a swing (112) commonly known in the trade as an "open top" swing. This title being derived from the fact that the swing (112) does not include a cross member interconnecting the leg connectors (120*a*, 120*b*). It has been found that it is desirable to have a swing (112) that does not have a cross-member thereby increasing the amount of access the operator has to an occupant contained within the seat (118).

The seat (118) is permitted to oscillate along an arcute path approximating pendulum motion. The energy required to start and maintain the pendulum motion of the swing (112) is commonly supplied by manual energy, such as a coil spring wound by the user, or by electrical energy that operates an electrical motor. However, one skilled in the art can appreciate that novel aspects of the present invention are equally applicable to various other swings regardless of the particular energy source.

Figure 3:
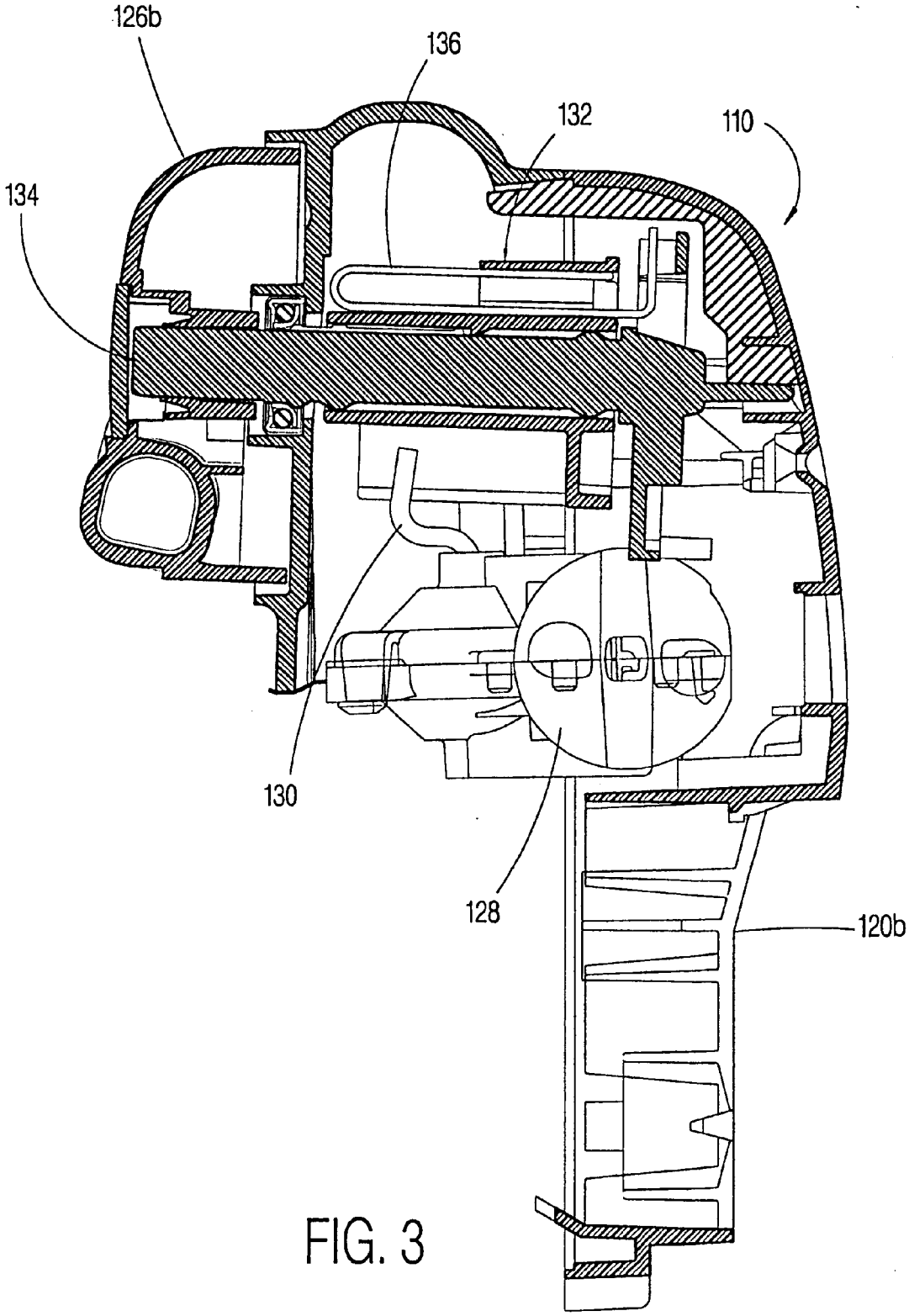
FIG. 3 shows a cross-sectional view of a hub and second leg connector housing the swing drive mechanism.

As shown in FIG. 3, the swing drive mechanism (110) of the present invention generally includes a motor (128) which powers a crank arm (130). The crank arm (130) is associated with an input mechanism (132) that translates the rotational motion of the crank arm (130) into an arcuately oscillating motion. The swing drive mechanism (110) further includes an output mechanism (134) associated with the input mechanism (132). Uniquely, a torsion spring member (136) is connected to the input mechanism (132).

Figure 5:
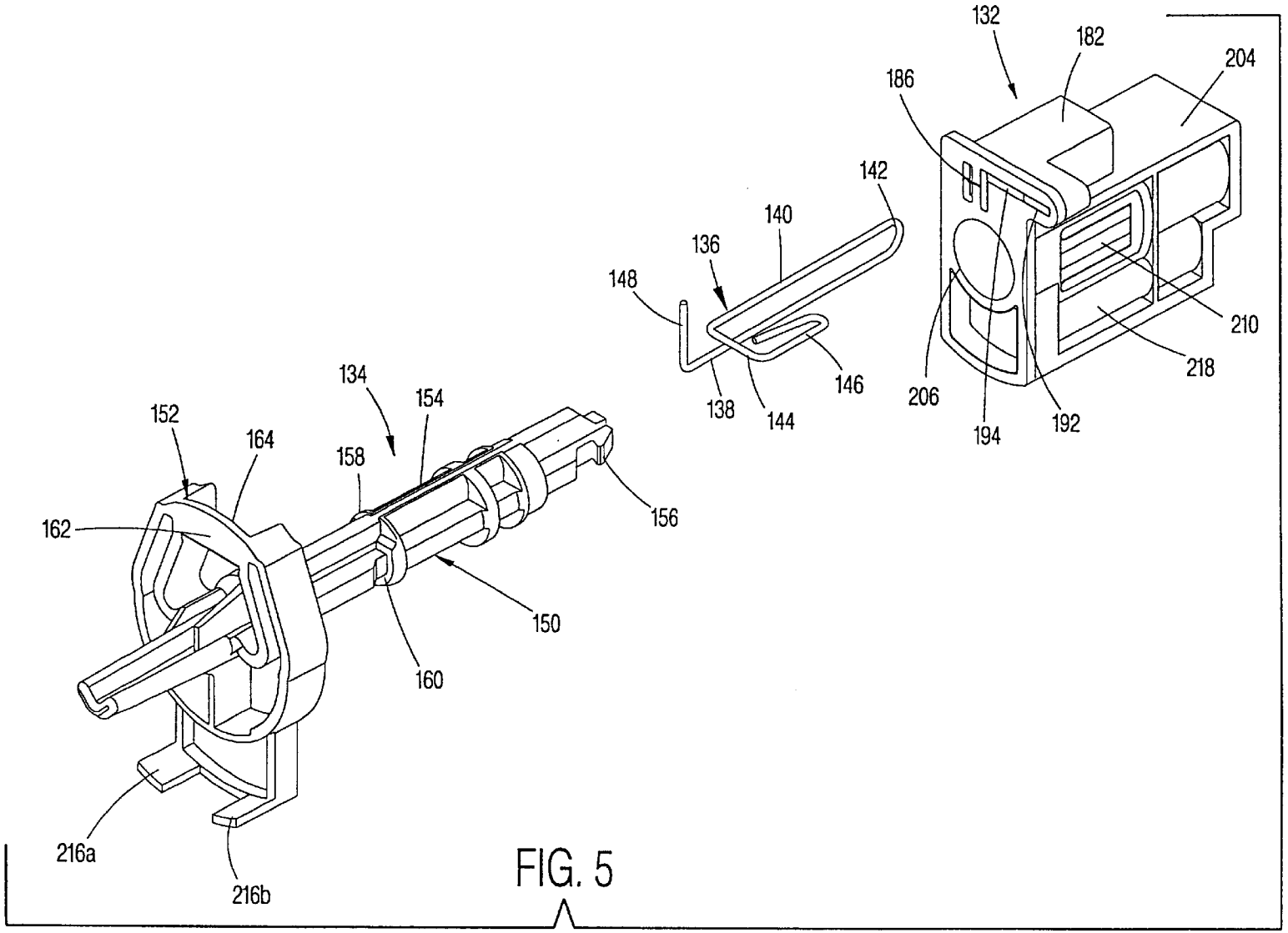
FIG. 5 shows an exploded perspective view of the swing drive mechanism with the output mechanism, the input mechanism and the torsion spring mechanism in an exploded orientation.

With particular reference to FIG. 5, the torsion spring member (136) of the present invention includes a first portion (138) having a first length and a second portion (140) having a second length. The second portion (140) is parallelly disposed and distanced apart relative to the first portion (138). The torsion spring member (136) includes a lever portion (148) approximately perpendicularly disposed relative to and extending from the first portion (138). Preferably, the first length of the first portion (138) is approximately equal to the second length of the second portion (140). However, one skilled in the art can best appreciate that the lengths of the first portion (138) and second portion (140) may be varied as required for a particular application. The torsion spring member (136) further includes a radiused portion (142) connecting the first portion (138) to the second portion (140). However, other shaped portions may also be used to interconnect the first portion (138) to the second portion (140) without departing from the teachings of this invention. Preferably, the first portion (138) and the second portion (140) are each substantially elongate and linear in shape. The torsion spring member (136) further includes a third portion (144) extending from the second portion (140) and approximately perpendicularly disposed relative to the first portion (138) and the lever portion (148). Lastly, the torsion spring member (136) includes a hook portion (146)

extending from the third portion (144). The hook portion (146) is substantially U-shaped. The hook portion (146), the third portion (144), the second portion (140), the radiused portion (142), the first portion (138), and the lever portion (148) are integrally formed together. In a preferred embodiment, the first portion (138), the radiuses portion (142) and the second portion (140) are substantially coplanar. Similarly, the second portion (140), the third portion (144), and the hook portion (146) are coplanar. In a most preferred embodiment, the torsion spring member (136) of this invention is constructed from drawn wire having a circular cross-section. However, various other materials and various other cross-sections may be utilized without departing from the novel aspects of this invention.

Figure 8:
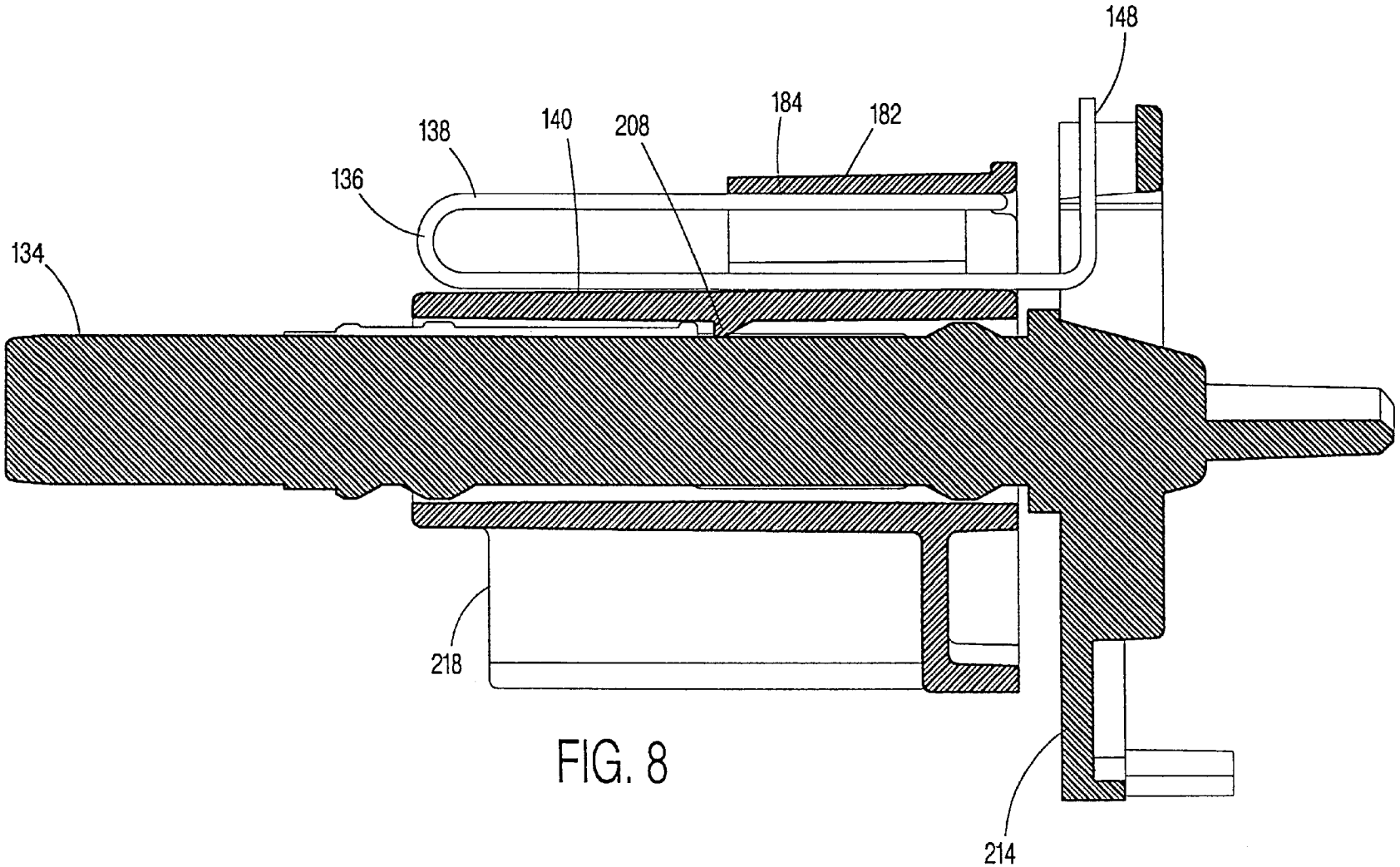
FIG. 8 shows a side cross-sectional view of the swing drive mechanism taken along line 8—8 of FIG. 6.

As best appreciated with reference to FIGS. 5 and 8, the output mechanism (134) of the present invention includes an axle (150) and a drive flange (152) attached to the axle (150). Specifically, the drive flange (152) includes a friction reducing mechanism. The axle (150) includes a first claw, not shown, and a second claw (156). The axle (150) also includes a retention ring (158) providing a retention ring surface (160) circumferentially disposed around the axle (150).

Figure 6:
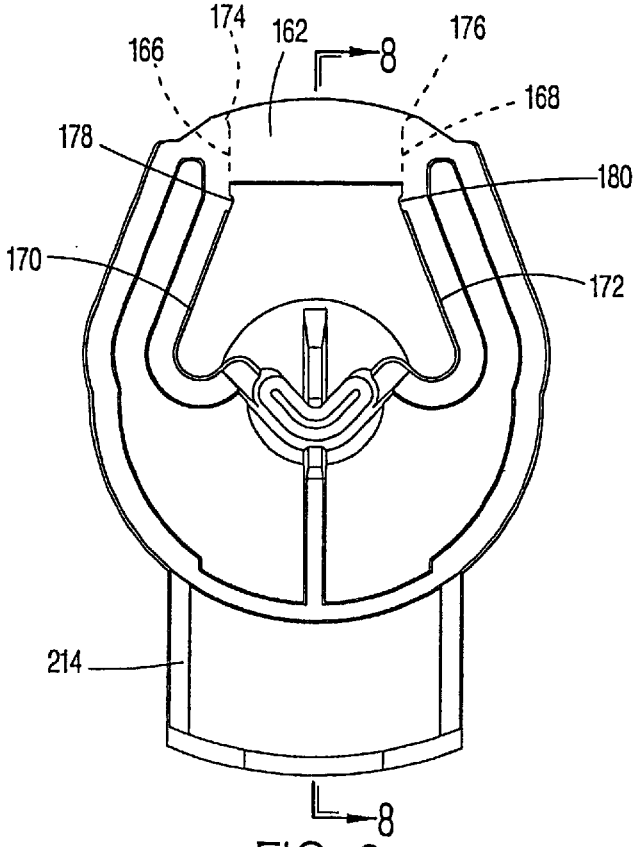
FIG. 6 shows a front elevation view of the swing output mechanism of the present invention.

As seen in FIG. 6, the drive flange (152) includes a face (162) having a cavity (164). The drive flange (152) also includes a first surface (166) and a second surface (168) disposed on the face (162). A first wall (170) and a second wall (172) are disposed proximate the first surface (166) and a second surface (168), respectively. The friction reducing mechanism includes a first radiused edge (174) and a second radiused edge (176). The first radiused edge (174) extends from the first surface (166) and the second radiused edge (176) extends from the second surface (168). Preferably, the first surface (166) and the second surface (168) are approximately parallel relative to one another while the first wall (170) and the second wall (172) are approximately skewed, or angularly disposed, relative to one another. Lastly, the drive flange (152) includes a radial extension (214) extending radially outward away from the face (162). Attached to the radial extension (214) is a pair of abutments (216*a*, 216*b*).

Figure 7:
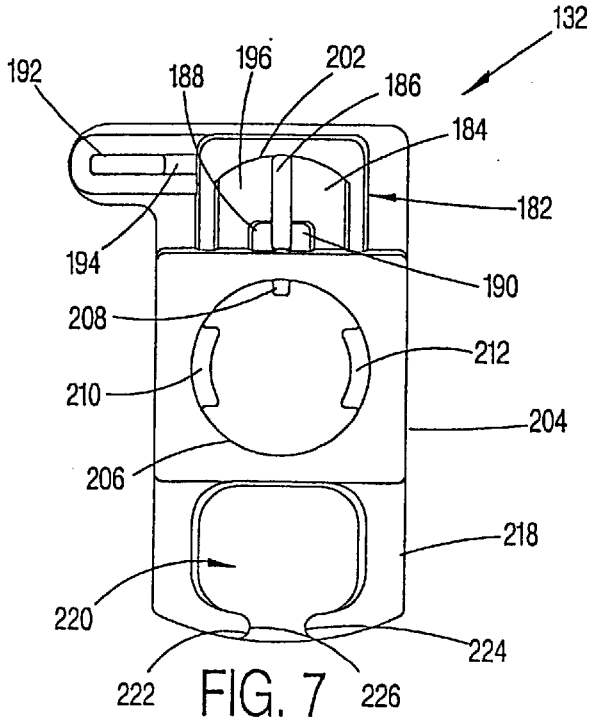
FIG. 7 shows a rear elevational view of the input mechanism.

The input mechanism (132) of the present invention includes a spring securement mechanism, an axle engagement mechanism proximate the spring securement mechanism and a crank engagement mechanism proximate the axle engagement mechanism. Specifically, as seen in FIG. 7, the spring securement mechanism includes a first body (182) having a chamber (184) through the first body (182). The chamber (184) terminating at an inner wall (196) having a slot (186) therethrough. The first body (182) further includes a first rib (188) and a second rib (190) disposed within the chamber (184). The first rib (188) and the second rib (190) are parallelly disposed relative to one another and aligned with the slot (186). Further, the first body (182) includes an opening (192) through the first body (182) and a ledge (194) extending within the opening (192). Preferably, the first rib (188) and the second rib (190) are space approximately the same distance apart as the width of the slot (186). Most preferably, the height of the slot (186) is approximately equal to the distance between the first portion (138) and the second portion (140) of the torsion spring member (136). Most preferably, the first body (182) includes roof (202) disposed above the first rib (188) and the second rib (190). In a highly preferred embodiment, the roof (202) is approximately arcuate in shape.

The axle engagement mechanism comprises a second body (204) having a hole (206) therethrough. Preferably, the second body (204) includes an alignment protrusion (208) extending within the hole (206). Most preferably, as best appreciated with reference to FIG. 7, the axle engagement mechanism includes a first finger (210) and a second finger (212), each of which extends into the hole (206).

The crank engagement mechanism comprises a third body (218) having a channel (220) therethrough. The third body (218) further includes a first drive surface (222) proximate the channel (220) and a second drive surface (224) approximately parallelly disposed relative to the first drive surface (222) and also disposed proximate the channel (220). Accordingly, the first drive surface (222) and the second drive surface (224) define a slit (226) therebetween. In a highly preferred embodiment, the first body (182), the second body (204), and the third body (218) are integrally formed together.

Figure 12:
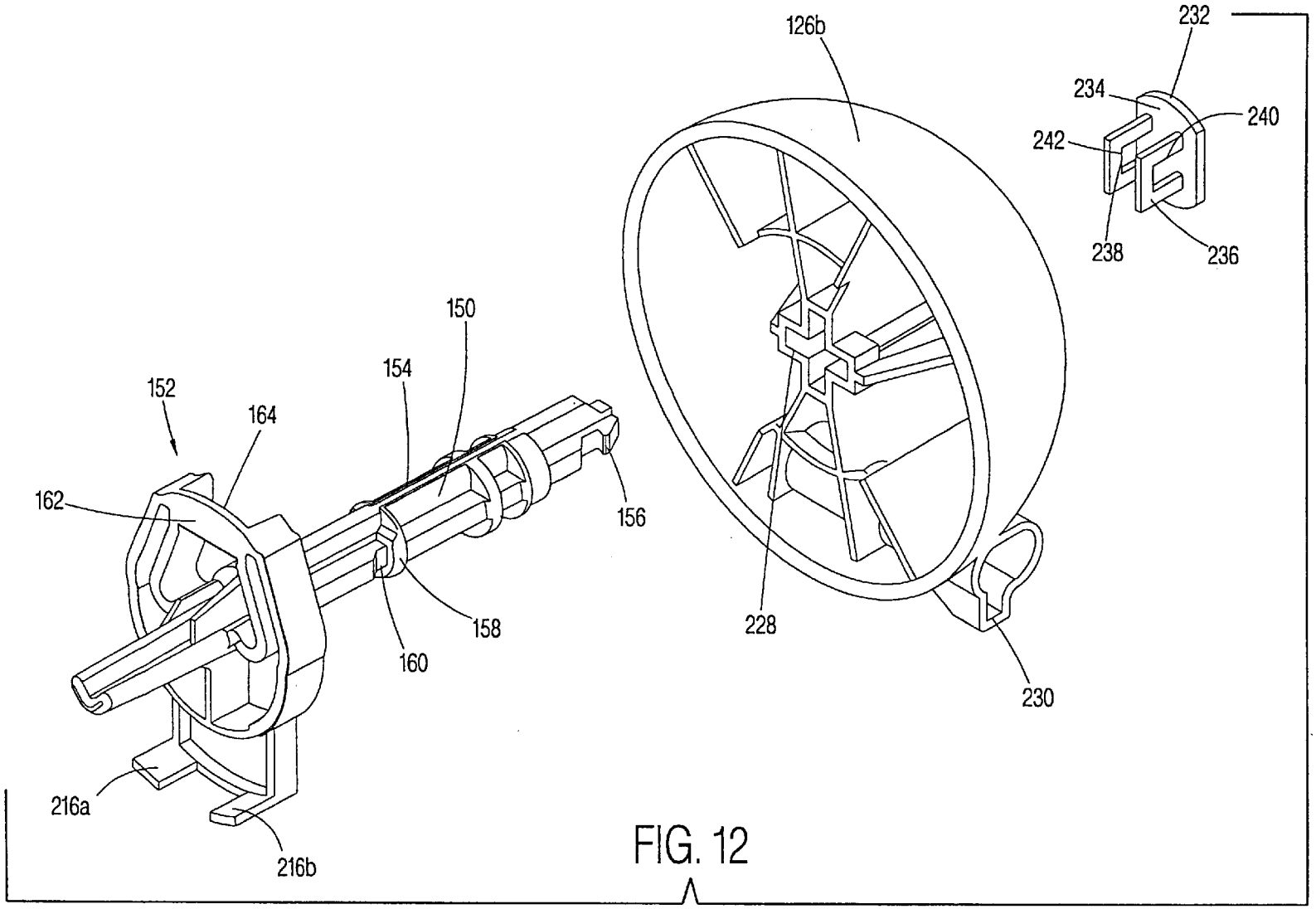
FIG. 12 shows an exploded perspective view of the output mechanism, a hub, and an axle lock.

The swing drive mechanism (110) of the present invention also includes an axle lock (232) to securely lock the axle (150) in association with the hub (126*b*). As best appreciated with reference to FIG. 12, the hub (126*b*) includes an axle socket (228) disposed thereon. Preferably, the hub (126*b*) includes a hanger joint (230) such that the hanger (1 16*b*) is coupled to the hub (126*b*). The axle lock (232) includes a stop member (234) having a first ear (236) and a second ear (238) extending therefrom. The first ear (236) includes a first orifice (240). Similarly, the second ear (238) includes a second orifice (242). The first orifice (240) is sized to receive the first claw (156). Similarly, the second orifice (242) is sized to receive the second claw, not shown. Preferably, the first ear (236) and the second ear (238) are elasticly deformable such that the first ear (236) and second ear (238) are elasticly flexed outward as the respective first claw (156) and second claw, not shown are inserted into the hub (126*b*). Once the first claw (156) and the second claw, not shown, are adjacent the respective first orifice (240) and the second orifice (242), the first ear (236) and the second ear (238), elasticly return to an undeformed orientation thereby securing the axle (150) to the hub (126*b*).

Figure 9:
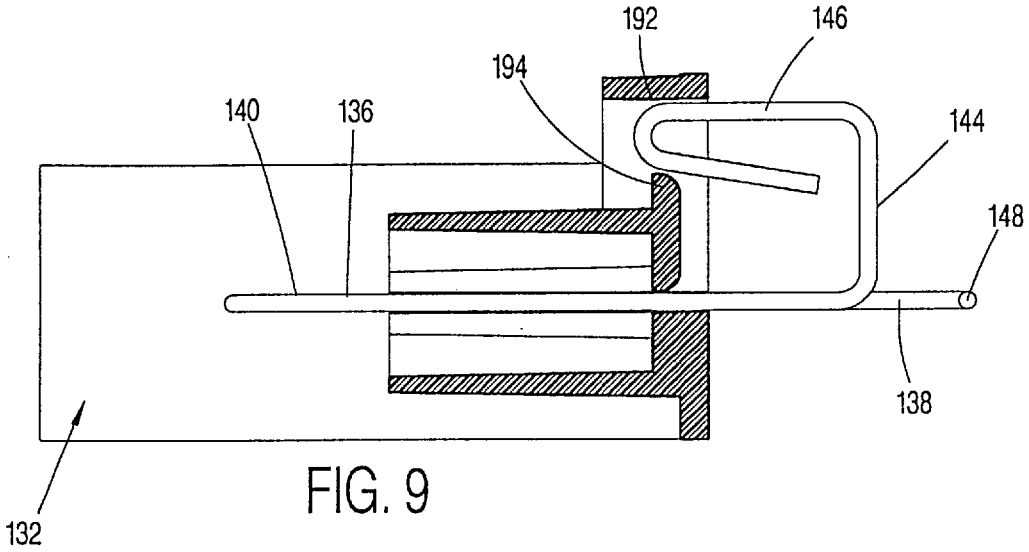
FIG. 9 shows a top cross-sectional view of the swing drive mechanism showing the torsion spring immediately before insertion into a spring retention mechanism.
Figure 10:
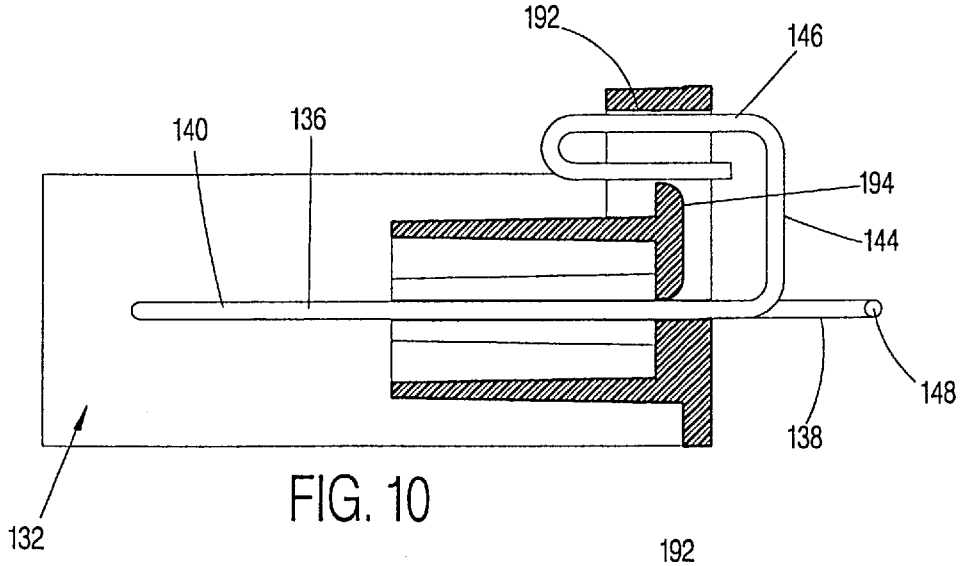
FIG. 10 shows a top cross-sectional view of the swing drive mechanism showing the torsion spring during insertion into a spring retention mechanism.
Figure 11:
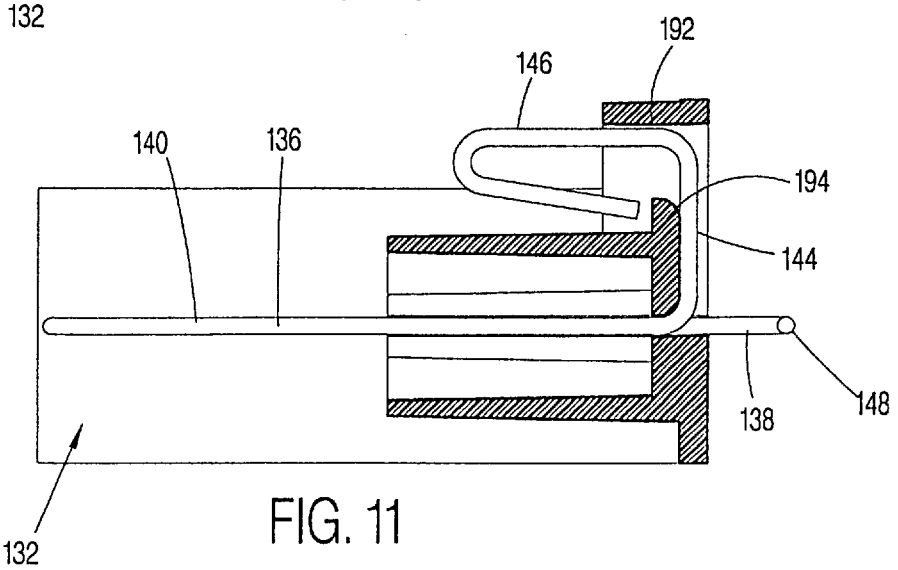
FIG. 11 shows a top cross-sectional view of the swing drive mechanism showing the torsion spring immediately after insertion into the spring retention mechanism.

The above disclosed invention provides a multitude of advantages. One specific advantage over the prior art is the that present invention provides a simplified assembly process. Specifically, The present invention substantially reduces the opportunity for the drive mechanism (110) of the present invention to be misassembled. To assemble the present invention, the worker simply inserts the torsion spring member (136) into association with the spring securement mechanism. Specifically, the user inserts the first portion (138) and the second portion (140) of the torsion spring member (136) through the slot (186) with the first portion (138) being aligned between the first rib (188) and the second rib (190). The second portion (140) being disposed proximate the roof (202) of the first body (182). During the above disclosed insertion process, the hook portion (146) is thereby simultaneously associated with the opening (192). FIGS. 9, 10, and 11 depict the insertion process in detail. As seen in FIG. 9, the hook portion (146) first is abutted against the ledge (194). Next, as seen in FIG. 10, as the worker continues to press the torsion spring member (136) towards the input mechanism (132), the hook portion (146) is flexed inward due to contacting the ledge (194). Lastly, as seen in FIG. 11, the hook portion (146) elasticly flexes outward once the hook portion (146) is pressed past the ledge (194). Accordingly, the torsion spring member (136) is securely retained in place by the spring securement mechanism.

Figure 4:
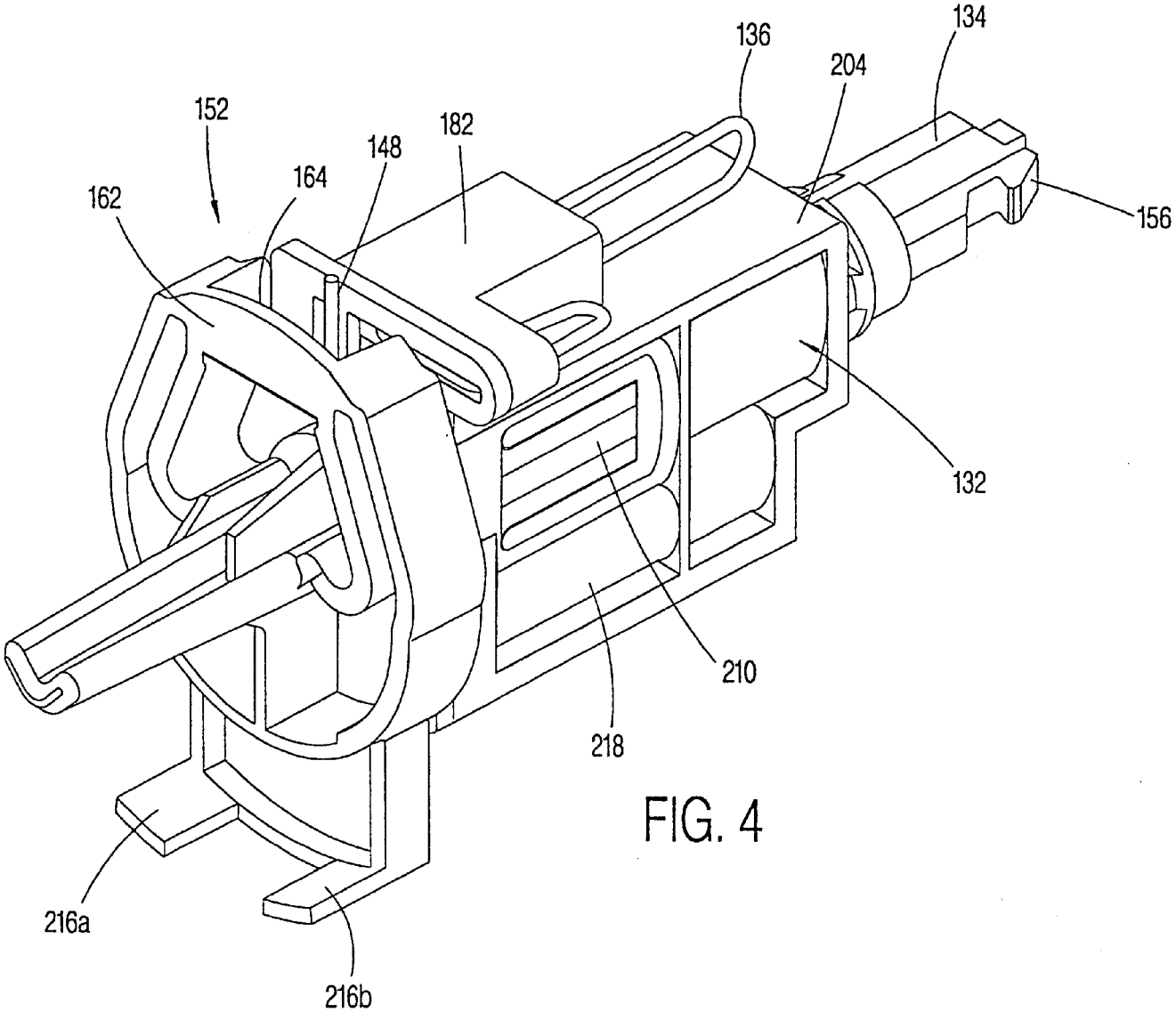
FIG. 4 shows a perspective view of the swing drive mechanism with an output mechanism, an input mechanism, and a torsion spring member in an assembled orientation.

Once the torsion spring member (136) is properly secured to the input mechanism (132), the input mechanism (132) is then associated with the output mechanism (134). The alignment protrusion (208) is aligned with the alignment groove (154) thereby ensuring that the input mechanism (132) is properly oriented relative to the output mechanism (134). As seen in FIG. 4, the lever portion (148) is thus properly nested within the cavity (164) of the face (162). Specifically, the worker then inserts the axle (150) into the hole (206) of the second body (204). As the worker slides the axle (150) into the hole (206), the first finger (210) and the second finger (212) are cambered outward over the retention ring (158). As the worker continues to slide the axle (150) along the hole (206), the retention ring (158) will slid rearward of the first finger (210) and the second finger (212) thereby securing the axle (150) due to an abutting relationship between the first finger (210) and second finger (212) relative to the retention ring surface (160) of the retention ring (158).

Once that the torsion spring member (136) is properly secured to the input mechanism (132) and that the input mechanism (132) is properly coupled to the output mechanism (134), the axle (150) is passed through a bearing, not shown, mounted in leg connector (120*b*) and is then coupled to the hub (126*b*). As best appreciated with reference to FIG. 12, the axle (150) includes a first claw (156) and a second claw, not shown, which engage the first orifice (240) and second orifice (242) respectively of the axle lock (232). Next, the crank arm (130) is inserted into the channel (220). The crank arm may include a round ball, not shown, for engagement with the channel (220). However, to further simplify assembly and reduce the overall number of parts, the round ball has been found to be unnecessary. Accordingly, in a preferred embodiment, during operation the crank arm (130) alternately engages the first drive surface (222) and the second drive surface (224).

In use, the crank arm (130) rotates along a circular path. The crank arm (130) alternatively engages the first drive surface (222) and the second drive surface (224). As such, the input mechanism (132) converts the rotational motion of the crank arm (130) into an arcuately oscillating motion relative to the axle (150). As the input mechanism (132) oscillates about the axle (150), the torsion spring member (136) pivot relative to the axle (150). Once the arc of the torsion spring member (136) becomes larger than the distance between the first radiused edge (174) and the second radiused edge (176), the torsion spring member (136) will be loaded by a force extending from one of the radiused edges (174, 176), depending on which direction the input mechanism (132) is pivoted relative to the output mechanism (134). Each radiused edge (174, 176) reduces friction as the lever portion (148) contacts the respective radiused edge (174, 176). In addition if the amplitude of the pendulum motion is increased past the intended pendulum amplitude, the lever portion (148) becomes distanced from the respective radiused edge (174, 176) and is then engaged by one of the nubs (178, 180). Each nub (178, 180) extends outward relative to the respective wall (170, 172) and surface (166, 168) such that as the torsion spring member (136) unwinds, the lever portion (148) safely engages the respective radiused edge (174, 176) thereby reducing the opportunity for undesirable wear and friction.

The present invention provides a multitude of advantages. As can be seen from the above, the present invention reduces the number of separate parts needed. As disclosed in a preferred embodiment, the drive flange (152) is preferably, integrally formed with the axle (150), the retention ring (158) is integrally formed on the axle (150), the input mechanism (132) is integrally formed together, each portion (148, 138, 142, 140, 144, and 146) of the torsion spring member (136) is integrally formed together. Ideally, the present invention reduces the part count of the swing drive mechanism (110). Although the preferred embodiment integrally forms several elements together, devices are integrally form fewer than all of the above members together are also contemplated by the present invention.

As seen from the above, the assembly of such a swing drive mechanism (110) substantially reduces the complexity in assembling such devices and also reduces the opportunity that such devices are misassembled. Yet, another advantage of this invention is that the swing drive mechanism (110) reduces wear and friction during operation. Specifically, friction and wear is reduced by the novel inclusion of the radiused edges (174, 176) and the nubs (178, 180) are extend outward into the cavity (164). Accordingly, the amount of energy required to operate such a devices is thereby reduced. In addition, failure due to friction is also reduced.

Lastly, the overall amount of space occupied by the swing drive mechanism (11) is minimized. The torsion spring member (136) of this invention uniquely includes a first portion (138) and a second portion (140). Both the first portion (138) and the second portion (140) are loaded once the lever portion (148) is engaged by the drive flange (152). Accordingly, the spring gradient achievable is approximately equal to that of a linear torsion spring of a single portion twice as long. One skilled in the art can best appreciate that the gradient for the torsion spring member (136) can be modified for a particular application by adjusting the length of either or both the first portion (138) or the second portion (140). In addition, the spring gradient is dependent upon the material utilized as well as the diameter of the torsion spring member (136). As such, the user of the present invention can substantially modify the diameters, lengths or material utilized to suit a particular application.

While this invention has been described in terms of a preferred embodiment, it is apparent that other forms could be adopted by one skilled in the art, for example by modifying the appearance or structure of the swing drive mechanism, or by substituting appropriate materials. Accordingly, the scope of this invention is to be limited only by the following claims.

What is claimed is:

1. A torsion spring for a swing drive mechanism, comprising:

a first portion;

a second portion adjoining the first portion and spaced apart from and parallel with the first portion;

a lever portion extending approximately perpendicular from the first portion and extending toward the second portion;

a third portion extending approximately perpendicular from the second portion and approximately perpendicular to the lever portion; and a hook portion extending from the third portion, wherein the first, second, and lever portion are in a first plane, and wherein the second, third, and the hook portions are in a second plane, which is different from the first plane.

2. A torsion spring according to claim 1, wherein the first plane and the second plane are perpendicular.

3. A torsion spring according to claim 1, wherein the first and second portions have approximately equal lengths.

4. A torsion spring according to claim 1, wherein the hook portion is substantially U-shaped, extending approximately perpendicular from the third portion.

5. A torsion spring according to claim 1, wherein the first, second, lever, third, and hook portions are integrally formed.

6. A swing drive mechanism comprising:

an axle;

a drive flange attached to the axle, the drive flange having a face and a cavity formed in the face, and first and second surface defining the cavity;

wherein the drive flange has a first radiused edge abutting the first surface and a second radiused edge abutting the second surface for reducing friction.

7. A swing drive mechanism according to claim 6, wherein the first and second surfaces are approximately parallel to each other.

8. A swing drive mechanism comprising:

an axle;

a drive flange attached to the axle, the drive flange having a face and a cavity formed in the face, first and second surface defining the cavity, and first and second walls disposed proximate the first and second surfaces, respectively;

wherein the drive flange has a first nub formed between the first wall and the first surface and a second nub formed between the second wall and the second surface for reducing friction.

9. A swing drive mechanism according to claim 8, wherein the first and second surfaces are approximately parallel to each other and the first and second walls are approximately angularly disposed relative to one another.

10. A swing drive mechanism comprising:

an input mechanism comprising a crank engagement means;

an axle engagement means proximate the crank engaging means, wherein the crank engagment means is substantially parallel to the axle engagement means;

a spring securement means proximate the axle engagement means, wherein the crank engagement means, axle engagement means, and spring engagement means being integrally formed together, wherein the spring securement means comprises a first body having a chamber therethrough and a slot therethrough, wherein the slot and the chamber are separate and distinct.

11. A swing drive mechanism comprising:

an input mechanism comprising a crank engagement means;

an axle engagement means proximate the crank engaging means, wherein the crank engagment means is substantially parallel to the axle engagement means;

a spring securement means proximate the axle engagement means, wherein the crank engagement means, axle engagement means, and spring engagement means being integrally formed together, wherein the spring securement means comprises a first body having an opening therethrough and a ledge extending within the opening, wherein the spring securement means comprises a separate and distinct chamber.

12. A swing drive mechanism comprising:

an input mechanism;

an output mechanism; and a torsional spring extending into the input mechanism, wherein the output mechanism includes an axle extending through the input mechanism, the axle being rotatable relative to the input mechanism, and a drive flange non-rotably connected to the axle, wherein the torsional spring engages the drive flange to oscillate the drive flange and thus the axle upon the input mechanism being driven to oscillate relative to the axle, wherein the torsional spring is positioned substantially parallel to the axle, and substantially coextensive with the input mechanism along the axle.

13. A swing drive mechanism according to claim 12, wherein the torsional spring includes:

a first portion;

a second portion adjoining the first portion and spaced apart from and parallel with the first portion;

a lever portion extending approximately perpendicular from the first portion and extending toward the second portion;

a third portion extending approximately perpendicular from the second portion and approximately perpendicular to the lever portion; and a hook portion extending from the third portion, wherein the first, second, and lever portion are in a first plane, and wherein the second, third, and the hook portions are in a second plane, which is different from the first plane.

14. A swing drive mechanism according to claim 13, wherein the first plane and the second plane are perpendicular.

15. A swing drive mechanism according to claim 13, wherein the first and second portions have approximately equal lengths.

16. A swing drive mechanism according to claim 13, wherein the hook portion is substantially U-shaped, extending approximately perpendicular from the -third portion.

17. A swing drive mechanism according to claim 13, wherein the first, second, lever, third, and hook portions are integrally formed.

18. A swing drive mechanism according to claim 13, wherein the input mechanism has a first slot that receives the first and second portions of the spring.

19. A swing drive mechanism according to claim 18, wherein the input mechanism has a second slot that receives the third and the hook portions, the second slot being perpendicular to the first slot.

20. A swing drive mechanism according to claim 19, wherein the second slot has a stop that abuts the third portion and prevents the torsion spring from moving inwardly into the input mechanism.

21. A swing drive mechanism according to claim 12, wherein the input mechanism has a slot extending substantially parallel to the axle adapted to receive a crank arm, the crank drive and the slot adapted to oscillate the input mechanism.

22. A swing drive mechanism according to claim 12, wherein the drive flange has a face and a cavity formed in the face, and first and second surface defining the cavity.

23. A swing drive mechanism according to claim 22, wherein torsion spring has a lever portion extending outwardly from the input mechanism, the lever portion engaging the first and second surfaces as the input mechanism oscillates, thus oscillating the axle.

24. A swing drive mechanism according to claim 23, wherein the drive flange has a first radiused edge abutting the first surface and a second radiused edge abutting the second surface for reducing friction.

25. A swing drive mechanism according to claim 24, wherein the drive flange further includes first and second walls disposed adjacent the first and second surfaces, respectively, wherein the drive flange has a first nub formed between the first wall and the first surface and a second nub formed between the second wall and the second surface for reducing friction.

26. A swing drive mechanism according to claim 25, wherein the first and second surfaces are approximately parallel to each other and the first and second walls are approximately angularly disposed relative to one another.

27. A swing drive mechanism comprising:

an output mechanism comprising an axle and a drive flange attached to said axle, said axle comprising an alignment groove disposed along the longitudinal direction of said axle, said axle further comprising a first claw connected to said axle and a second claw connected to said axle, said axle further comprising an input mechanism retention ring circumferentially disposed around said axle, said drive flange further comprising a face having an cavity, said face further comprises a first edge proximate the periphery of said face and a second edge proximate the periphery of said face, said face further comprises a first surface disposed proximate to said first edge and a second surface disposed proximate to said second edge, said face further comprises a first wall disposed proximate to said first surface and a second wall disposed proximate to said second surface, said face further comprises a first nub interconnecting said first surface to said second wall and a second nub interconnecting said second surface to said second wall, said face further comprises a radial extension extending from said face; and an input mechanism comprising a spring securement mechanism, said input mechanism further comprising an axle engagement mechanism proximate said spring securement mechanism, said input mechanism further comprising a crank engagement mechanism proximate said axle engagement mechanism, said spring securement mechanism comprises a first body having a chamber therethrough, said first body further having a slot through said body, said first body further comprises a first rib disposed within said chamber and a second rib disposed within said chamber, said second rib being parallelly disposed and spaced apart relative to said first rib, said spring securement member further comprises said first body having an opening through said body and a ledge extending within said opening, said axle engagement member comprises a second body having a hole therethrough, said second body further comprises an alignment protrusion extending within said hole, said second body further comprises a first finger extending along said hole and a second finger extending along said hole, said crank engagement mechanism further comprises a third body having a channel therethrough said third body further comprises a first drive surface disposed proximate said channel and a second drive surface disposed proximate said channel, whereby said first drive surface and said second drive surface define a slit therebetween; and torsion spring member comprising a first portion having a length, said torsion spring further comprising a second portion parallelly disposed and distanced apart relative to said first portion, said second portion having a length, said torsion spring further comprising a radiuses portion interconnecting said first portion and said second portion, said torsion spring member further comprises a lever attached to said first portion, said torsion member further comprises a third portion attached to said second portion, said torsion member further comprises a hook portion attached to said third portion, whereby said hook portion, said third portion, said second portion, said radiuses portion, said first portion, said lever portion are integrally formed together, said hook portion, said interconnection portion, said second portion being disposed approximately coplanar when said torsion spring member is in an unengaged orientation, and said second portion, said first portion and said lever portion being approximately coplanar when said torsion spring member is in an unengaged orientation.

* * * * *